US012290103B2

(12) United States Patent
Zhou et al.

(10) Patent No.: US 12,290,103 B2
(45) Date of Patent: May 6, 2025

(54) ATOMIZER AND ELECTRONIC ATOMIZING DEVICE HAVING THE SAME

(71) Applicant: Jiangmen Moore Technology.,Ltd, Jiangmen (CN)

(72) Inventors: Weidong Zhou, Jiangmen (CN); Fengwen Lu, Jiangmen (CN); Min Wang, Jiangmen (CN); Xiaoan Zhu, Jiangmen (CN)

(73) Assignee: Jiangmen Moore Technology., Ltd, Jiangmen (CN)

( * ) Notice: Subject to any disclaimer, the term of this patent is extended or adjusted under 35 U.S.C. 154(b) by 474 days.

(21) Appl. No.: 17/534,906

(22) Filed: Nov. 24, 2021

(65) Prior Publication Data

US 2022/0160038 A1 May 26, 2022

(30) Foreign Application Priority Data

Nov. 25, 2020 (CN) ..... 202022748909.9

(51) Int. Cl.

| | |
|---|---|
| ***A24F 40/40*** | (2020.01) |
| ***A24F 40/42*** | (2020.01) |
| ***A24F 40/46*** | (2020.01) |
| ***A24F 40/70*** | (2020.01) |
| ***H01R 13/41*** | (2006.01) |

(52) U.S. Cl.

CPC ..... *A24F 40/46* (2020.01); *A24F 40/42* (2020.01); *A24F 40/70* (2020.01)

(58) Field of Classification Search

None

See application file for complete search history.

(56) References Cited

U.S. PATENT DOCUMENTS

2013/0306065 A1* 11/2013 Thorens ..... A24F 40/40 128/202.21
2023/0000158 A1* 1/2023 Zhao ..... A24F 40/46

FOREIGN PATENT DOCUMENTS

| | | | | |
|---|---|---|---|---|
| CN | 105768239 A | | 7/2016 | |
| CN | 105768239 B | | 3/2019 | |
| CN | 109393570 A | * | 3/2019 | ..... A24F 47/008 |
| CN | 209047465 U | | 7/2019 | |
| CN | 210901373 U | | 7/2020 | |
| CN | 210929624 U | | 7/2020 | |

(Continued)

OTHER PUBLICATIONS

KR20130005773U English translation obtained from Espacenet Feb. 7, 2024 (Year: 2024).*

(Continued)

*Primary Examiner* — Philip Y Louie
*Assistant Examiner* — Eric M Fierce
(74) *Attorney, Agent, or Firm* — Dorsey & Whitney LLP

(57) ABSTRACT

The present disclosure relates to an atomizer and an electronic atomizing device. The atomizer includes a base assembly, an atomizing core and an electrode body. A mounting hole in fluidly communication with an outside atmosphere is formed in the base assembly. The atomizing core is at least partially located in the base assembly and used for atomizing liquid. The electrode body includes a conductive post electrically connected to the power supply and the atomizing core. The conductive post includes a cylinder portion with a circular cross-section. The cylinder portion is in interference fit with the mounting hole to seal the mounting hole.

11 Claims, 11 Drawing Sheets

(56) References Cited

FOREIGN PATENT DOCUMENTS

| | | | | | |
|---|---|---|---|---|---|
| FR | 2606941 | A1 | | 5/1988 | |
| KR | 20130005773 | U | * | 10/2013 | ..... A24F 40/53 |

OTHER PUBLICATIONS

CN109393570A English translation obtained from Espacenet Feb. 7, 2024 (Year: 2024).*
Office Action dated Sep. 1, 2021 for Chinese Application No. 202022748909.9.
Extended European Search Report for European Application No. mailed Apr. 13, 2022.

* cited by examiner

ATOMIZER AND ELECTRONIC ATOMIZING DEVICE HAVING THE SAME

CROSS-REFERENCE OF RELATED APPLICATION

This application claims the priority of a Chinese patent application 202022748909.9, filed on Nov. 25, 2020, and entitled "ATOMIZER AND ELECTRONIC ATOMIZING DEVICE", the entire content of which is incorporated herein by reference.

TECHNICAL FIELD

The present disclosure relates to the technical field of atomizer, in particular to an atomizer and an electronic atomizing device including the atomizer.

BACKGROUND

There are dozens of carcinogens in the smoke of tobacco burning. For example, tar can cause great harm to human health, and the smoke diffuses in the air forms second-hand smoke, which can also cause harm to the body after inhalation by the surrounding people. Smoking is explicitly prohibited in most public places. The electronic atomizing device has an appearance and a taste which are similar to that of ordinary cigarettes, but usually does not contain other harmful components such as tar and suspended particles in the cigarette. Therefore, the electronic atomizing device is generally used as a substitute for cigarettes.

A conventional electronic atomizing device includes an atomizer and a power supply. The atomizer includes an atomizing core and an electrode post. The electrode post is electrically connected to the atomizing core and the power supply at the same time, such that the power supply supplies power to the atomizing core through the electrode post, such that the atomizing core converts electrical energy into heat energy required to atomize the liquid. Generally, a part of the liquid buffered in the atomizing core can seep from the surface of the atomizing core to form a leaking liquid. The leaking liquid usually flow out of the atomizing core along the electrode post and flows into the power supply to cause erosion. Of course, a sealing structure can be used to seal the electrode post, but the structure of the atomizer will be more complicated.

SUMMARY

According to various exemplary embodiments, the present disclosure provides an atomizer and an electronic atomizing device including the same.

An atomizer includes: a base assembly provided with a mounting hole in fluidly communication with an outside atmosphere; an atomizing core at least partially located in the base assembly and configured to atomize liquid; and an electrode body including a conductive post electrically connected to the atomizing core, the conductive post includes a cylinder portion with a circular cross-section, and the cylinder portion is in interference fit with the mounting hole to seal the mounting hole.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

In order to facilitate the understanding of the present disclosure, the present disclosure will be described more completely hereinafter with reference to the related accompanying drawings. Preferable embodiments of the present disclosure are presented in the accompanying drawings. However, the present disclosure may be embodied in many different forms and is not limited to the embodiments described herein. Rather, these embodiments are provided so that the understanding of the disclosure of the present disclosure will be more thorough and complete.

It should be understood that when an element is defined as "fixed to" another element, it is either directly on an element or indirectly on an element with a mediating element. When an element is considered to be "connected" to another element, it can be directly connected to another element or indirectly connected to another element with a mediating element. The terms "in", "out", "left", "right" and similar expressions used herein are for illustrative purposes only and are not meant to be the only implementation.

Figure 1:
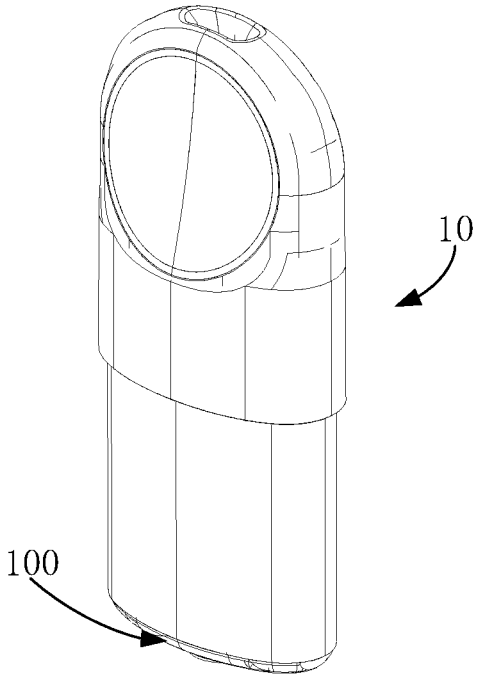
FIG. 1 is a perspective view of an atomizer according to a first embodiment.
Figure 2:
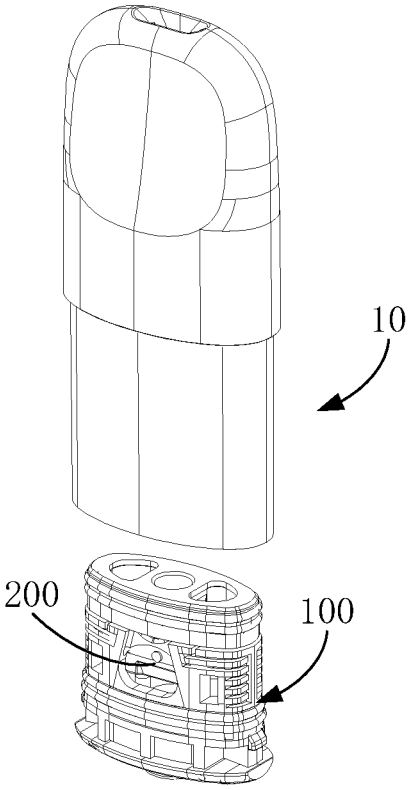
FIG. 2 is an exploded view of the atomizer shown in FIG. 1.
Figure 12:
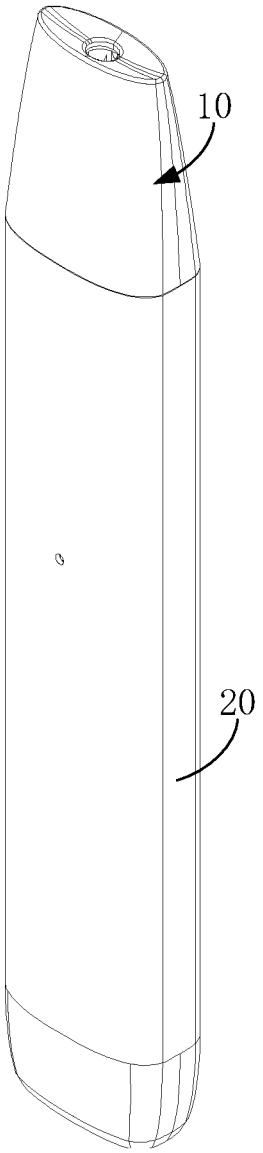
FIG. 12 is a perspective view of an electronic atomizing device according to an embodiment.

Referring to FIGS. 1, 2, and 12, an electronic atomizing device according to an embodiment of the present disclosure includes an atomizer 10 and a power supply 20. The power supply 20 is connected to the atomizer 10, for example, the atomizer 10 and the power supply 20 are detachably connected. The power supply 20 supplies power for the atomizer 10, which converts electrical energy into thermal energy, and liquid in the atomizer 10 absorbs the thermal energy and atomizes to form smoke that can be inhaled by the user. The liquid may be e-liquid such as an aerosol.

When all of the liquid in the atomizer 10 is consumed, the atomizer 10 may be detached from the power supply 20 and discarded, and then a new atomizer 10 filled with liquid may be reinstalled on the power supply 20. Therefore, the atomizer 10 may be a disposable component, while the power supply 20 may be reused. After the electric energy in the power supply 20 is consumed completely, the power supply 20 may be charged by an external charging device, such that the power supply 20 can be recycled.

Figure 3:
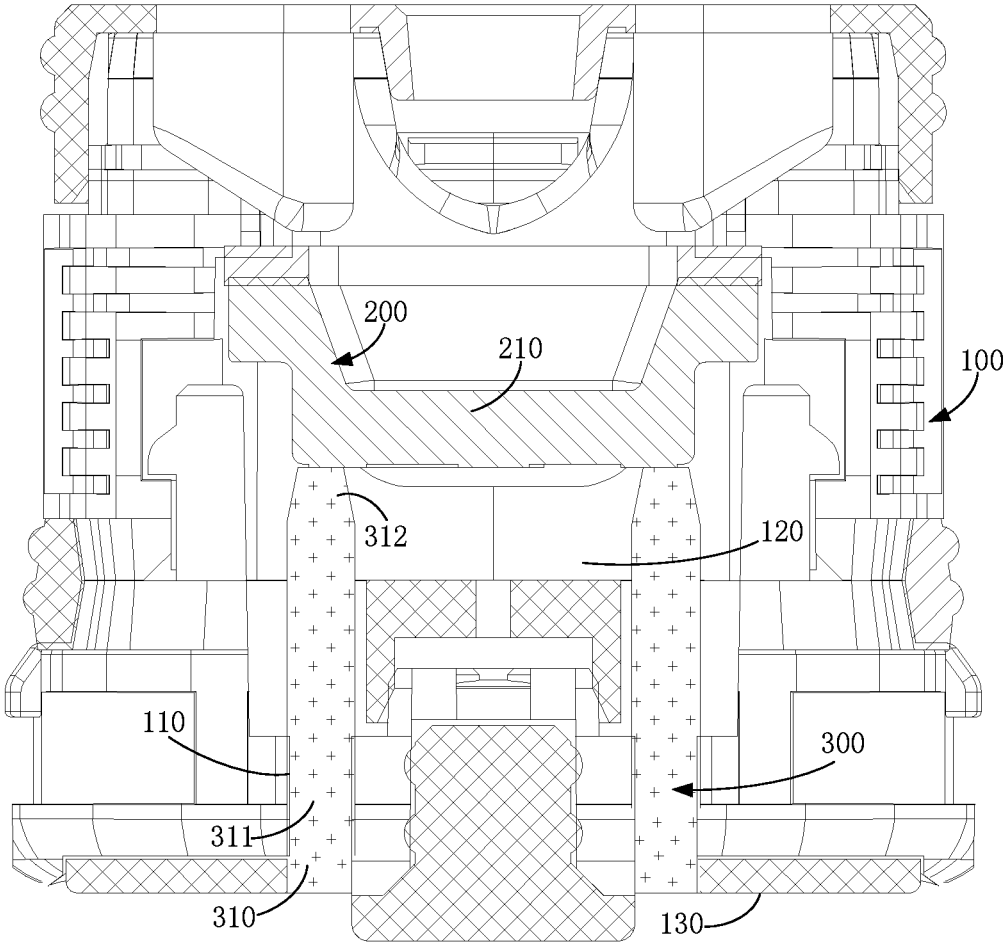
FIG. 3 is a cross-sectional view of the atomizer shown in FIG. 1.
Figure 4:
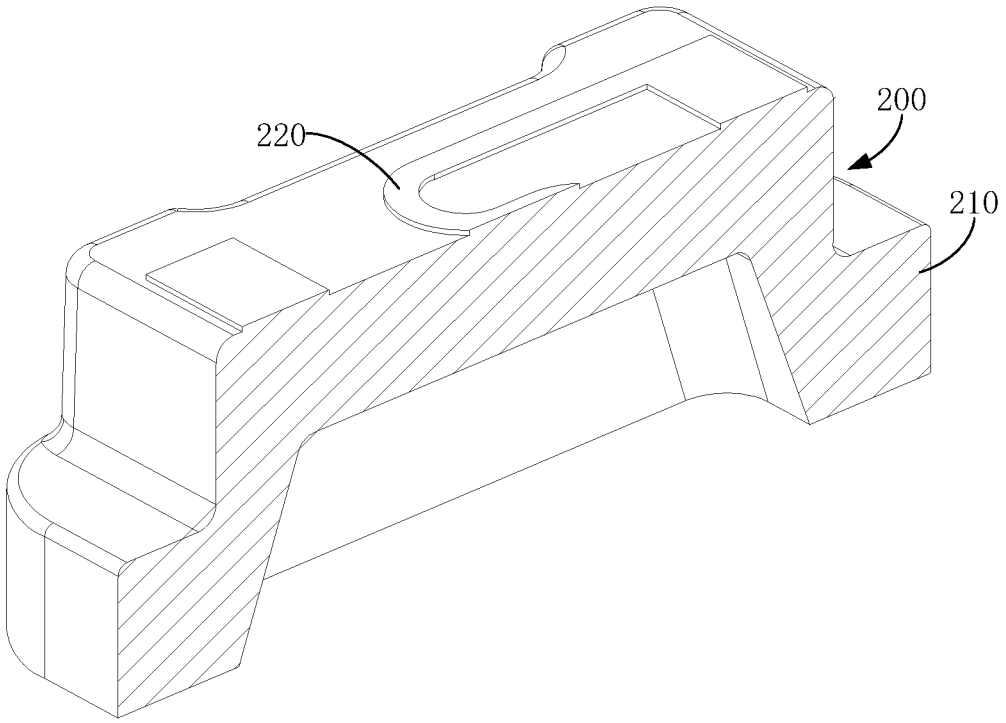
FIG. 4 is a perspective cross-sectional view of the atomizing core.
Figure 5:
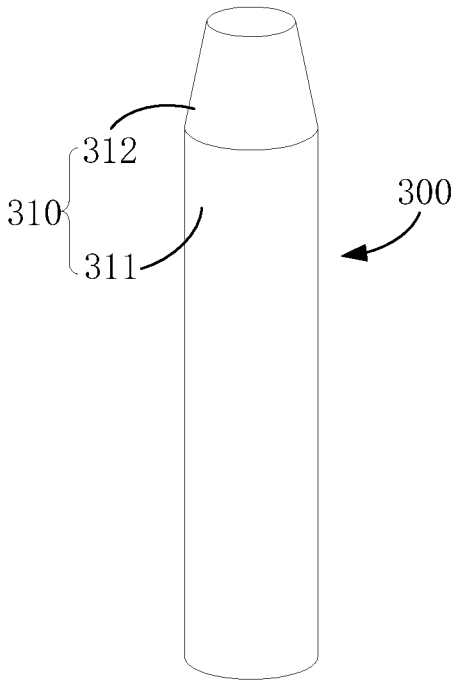
FIG. 5 is a perspective view of an electrode body.

Referring to FIGS. 3, 4, and 5, according to a first embodiment, the atomizer 10 includes a base assembly 100, an atomizing core 200, and an electrode body 300. The base assembly 100 defines an atomizing cavity 120 and a mounting hole 110. The mounting hole 110 extends in a vertical direction and is located below the atomizing cavity 120, such that one end (upper end) of the mounting hole 110 is in fluidly communication with the atomizing cavity 120 and the other end (lower end) of the mounting hole 110 is in fluidly communication with an outside atmosphere. The base assembly 100 has a mounting surface 130 facing the power supply 20, for example, the mounting surface 130 may be in direct contact with the power supply 20. The mounting hole 110 may be a circular hole, that is, the cross-section of the mounting hole 110 has a shape of circle, and a diameter of the mounting hole 110 is kept constant along an axial direction (i.e., the vertical direction) of the mounting hole 110. In other embodiments, the mounting hole 110 may be a square hole or the like, that is, the cross-section of the mounting hole 110 has a shape of square.

The atomizing core 200 includes a ceramic substrate 210 and a heating body 220. The ceramic substrate 210 may be made of porous ceramic material, such that a large number of micropores exist inside the ceramic substrate 210 to form a certain porosity, and the micropores may have a capillary action, such that the ceramic substrate 210 can absorb and buffer the liquid stored in the atomizer. The ceramic substrate 210 has an atomizing surface located in the atomizing cavity 120. The heating body 220 may be made of metal material and is attached to the atomizing surface. When energized, the heating body 220 has a reasonable resistance value can convert electrical energy into thermal energy, and the liquid on the atomizing surface will be atomized into smoke by the thermal energy of the heating body 220.

The electrode body 300 includes a conductive post 310, and the conductive post 310 may be made of metal material having a relatively low resistivity, such that the resistance value of the conductive post 310 is relatively low, and the conductive performance of the electrode body 300 is improved. The conductive post 310 may include a circular truncated cone portion 312 disposed at an end of the cylinder portion 311, and the circular truncated cone portion 312 is coaxially arranged with the cylinder portion 311. the cross-section of the cylinder portion 311 has a shape of circle, and a dimension of the cross-section of the cylinder portion 311 is kept constant, that is, a diameter of the cylinder portion 311 is kept constant along an axial direction of the entire conductive post 310. The cross-section of the circular truncated cone portion 312 also has a shape of circle, and a dimension of the cross-section of the circular truncated cone portion 312 is gradually reduced, that is, a diameter of the circular truncated cone portion 312 is gradually reduced along the axial direction of the conductive post 310 close to the atomizing core 200 (i.e., from the bottom to the top).

In the mounting process, the diameter of the cylinder portion 311 is greater than the diameter of the mounting hole 110, such that the cylinder portion 311 and the mounting hole 110 form an interference fit relationship, and the interference degree between the cylinder portion 311 and the mounting hole 110 can be reasonably configured according to the actual situation. The lower end of the cylinder portion 311 may abut against the electrode of the power supply 20, and the upper end of the circular truncated cone portion 312 may abut against the electrode of the heating body 220 on the atomizing core 200, such that electrical connection between the power supply 20 and the heating body 220 can be achieved, that is, the power supply 20 may supply electrical energy to the heating body 220 via the conductive post 310. Since the dimension of the cross-section of the circular truncated cone portion 312 is gradually reduced from the bottom to the top, when the conductive post 310 is inserted into the mounting hole 110, a gap is formed between the circular truncated cone portion 312 and the mounting hole 110, such that the circular truncated cone portion 312 is easily inserted into the mounting hole 110 to form a certain guiding action, such that the mounting difficulty between the subsequent cylinder portion 311 and the mounting hole 110 can be reduced, and the mounting efficiency and the mounting accuracy of the entire conductive post 310 and the mounting hole 110 can be improved.

The cylinder portion 311 has a good sealing effect on the entire mounting hole 110 via the interference fit relationship between the cylinder portion 311 and the mounting hole 110. When the liquid leaking from a surface of the atomizing core 200 flows along the conductive post 310, the leaking liquid cannot enter the mounting hole 110 due to the cylinder portion 311, thereby preventing the leaking liquid from flowing out of the atomizer 10 through the mounting hole 110 and eroding and damaging the power supply 20, improving the service life of the electronic atomizing device, and preventing the power supply 20 from explosion caused by the leaking liquid, thereby improving the safety of the electronic atomizing device. Further, the mounting hole 110 can be sealed only by the interference fit between the cylinder portion 311 and the mounting hole 110, thereby omitting the sealing structure such as a sealing ring, thereby simplifying the structure of the atomizer 10, achieving a miniaturized design of the atomizer 10, and reducing the manufacturing cost of the atomizer 10. In one embodiment, a liquid storage space may be provided in the atomizer 10, and the leaking liquid flowing out from the surface of the atomizing core 200 may be introduced into the liquid storage space, such that the liquid storage space has a good buffer action for the leaking liquid and prevents the leaking liquid from flowing from the atomizer 10 to the power supply 20 to form an erosion to the power supply 20.

In one embodiment, the conductive post 310 may be made of magnetic or ferromagnetic material, such that the conductive post 310 has certain magnetic or ferromagnetic properties. When the conductive post 310 is in contact with the electrode of the power supply 310, both the conductive post 310 and the electrode of the power supply 310 are in contact with each other via a magnetic attraction force, so as to avoid poor contact between the conductive post 310 and the electrode of the power supply 310, thereby improving the reliability of the electrical connection between the conductive post 310 and the electrode of the power supply 310. In addition, since the conductive post 310 is made of magnetic or ferromagnetic material, the conductive and magnetic attraction effects of the conductive pillar 310 are achieved at the same time, and that additional use of magnets on the base assembly 300 for fixedly connecting the atomizer 10 and the power supply 20 may be omitted. It should be noted that the conductive post 310 may be made of one of magnetic or ferromagnetic materials, and one of the ferromagnetic or magnetic members may be provided corresponding to the power supply 310 configured to generate magnetic attraction with the conductive post 310.

Figure 6:
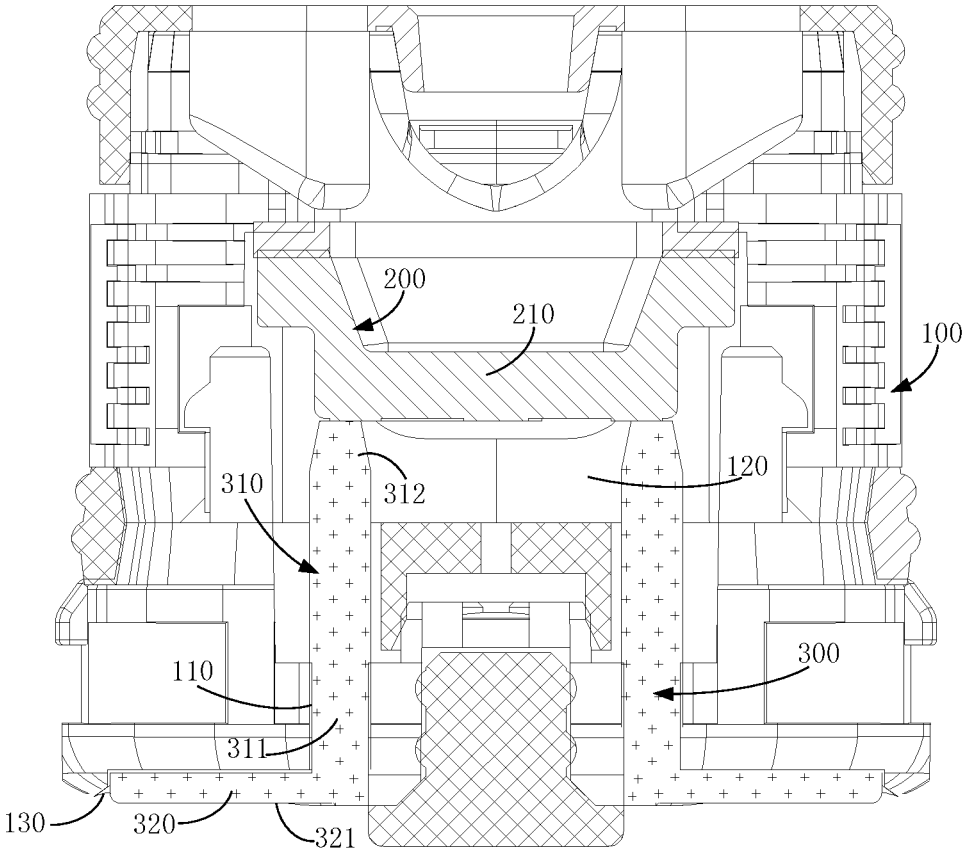
FIG. 6 is a cross-sectional view of an atomizer according to a second embodiment.
Figure 7:
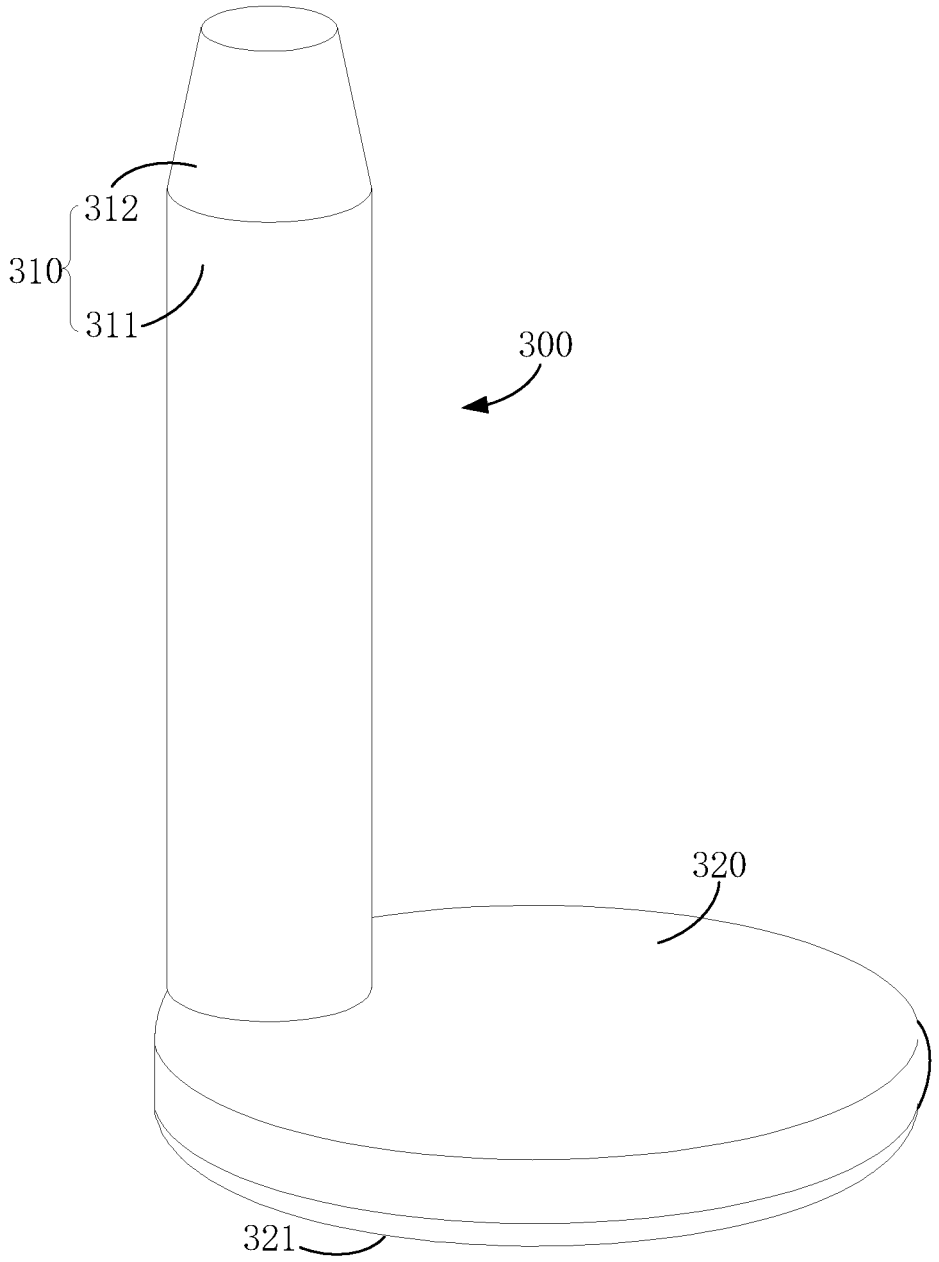
FIG. 7 is a perspective view of an electrode body of the atomizer shown in FIG. 6.
Figure 8:
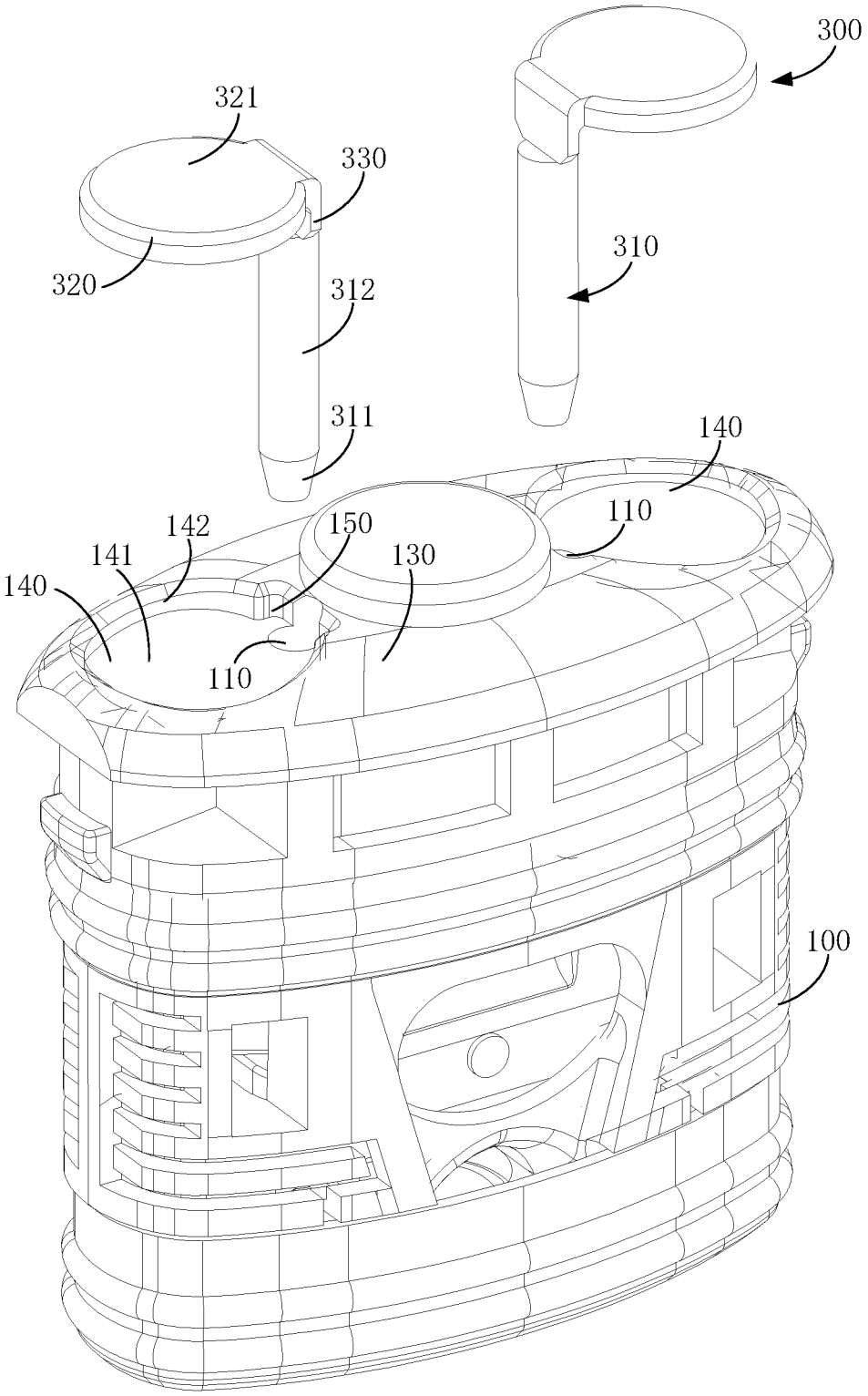
FIG. 8 is a perspective view of an atomizer according to a third embodiment.
Figure 9:
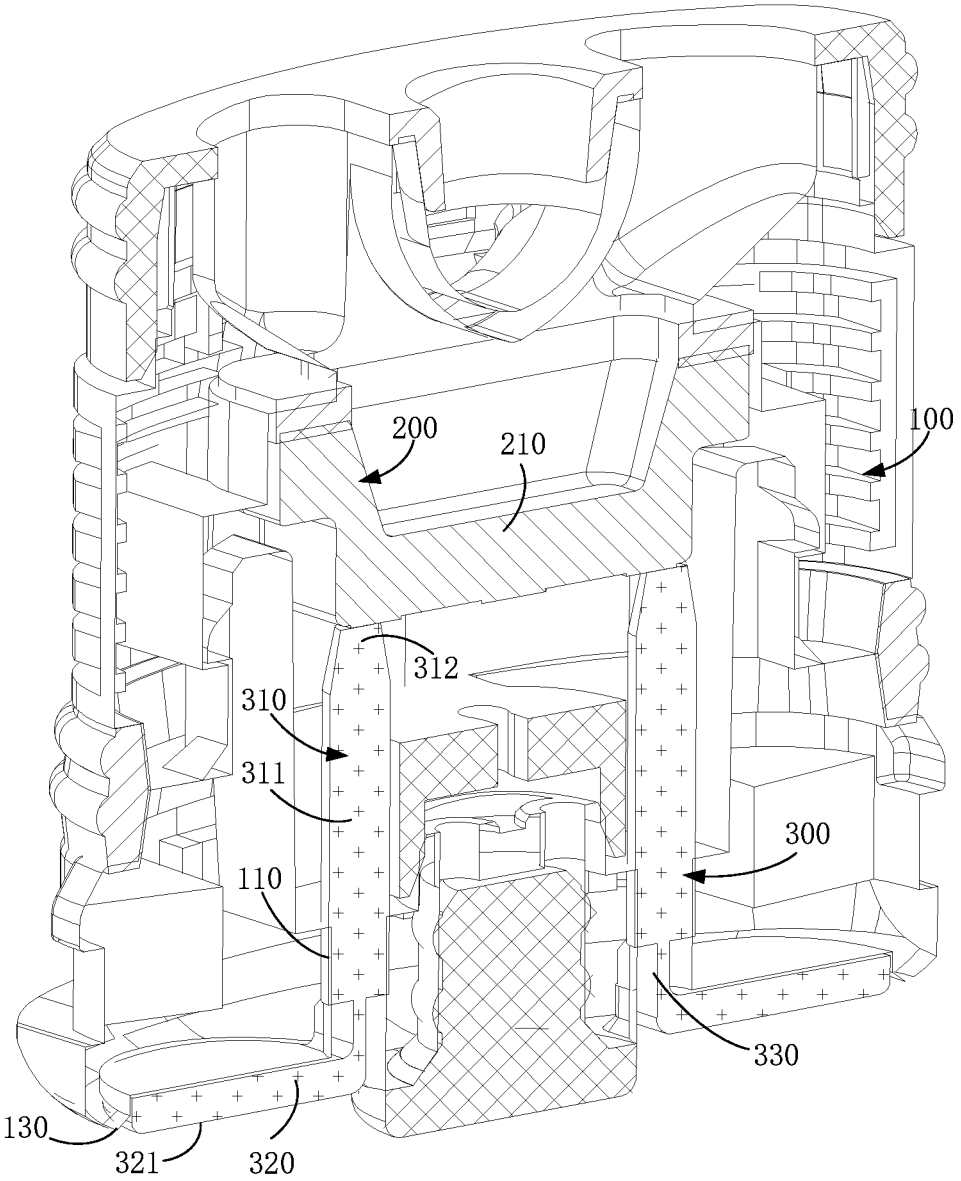
FIG. 9 is a perspective cross-sectional view of the atomizer shown in FIG. 8.
Figure 10:
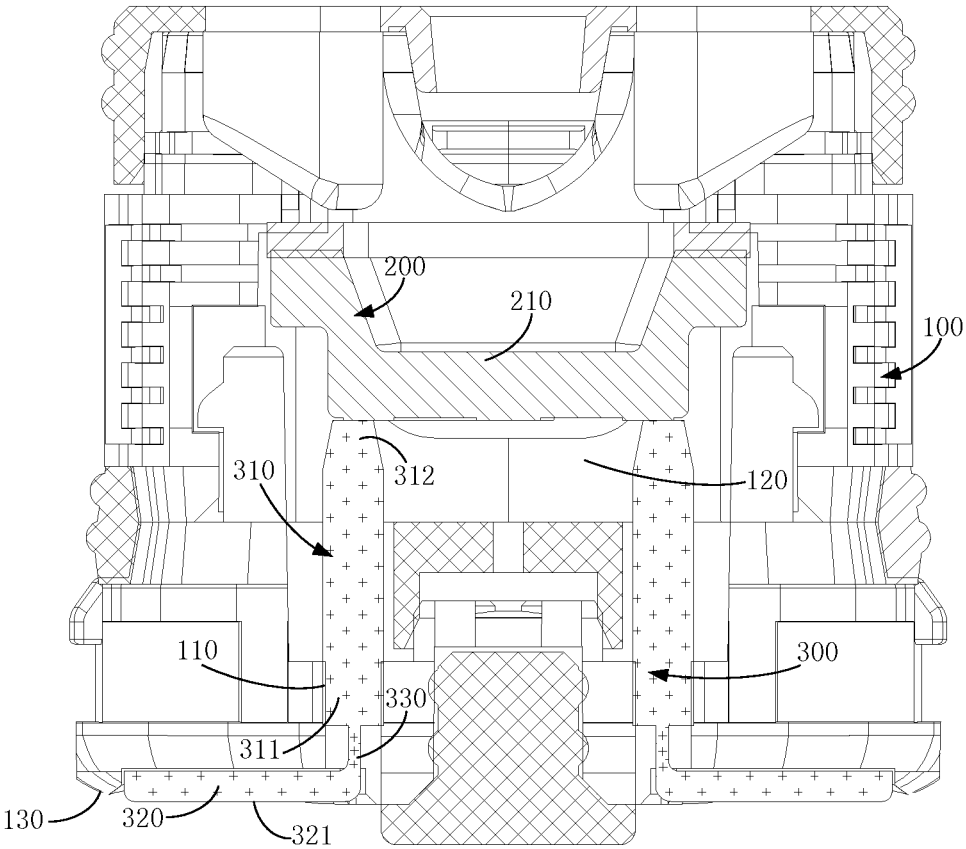
FIG. 10 is a cross-sectional view of the atomizer shown in FIG. 8.
Figure 11:
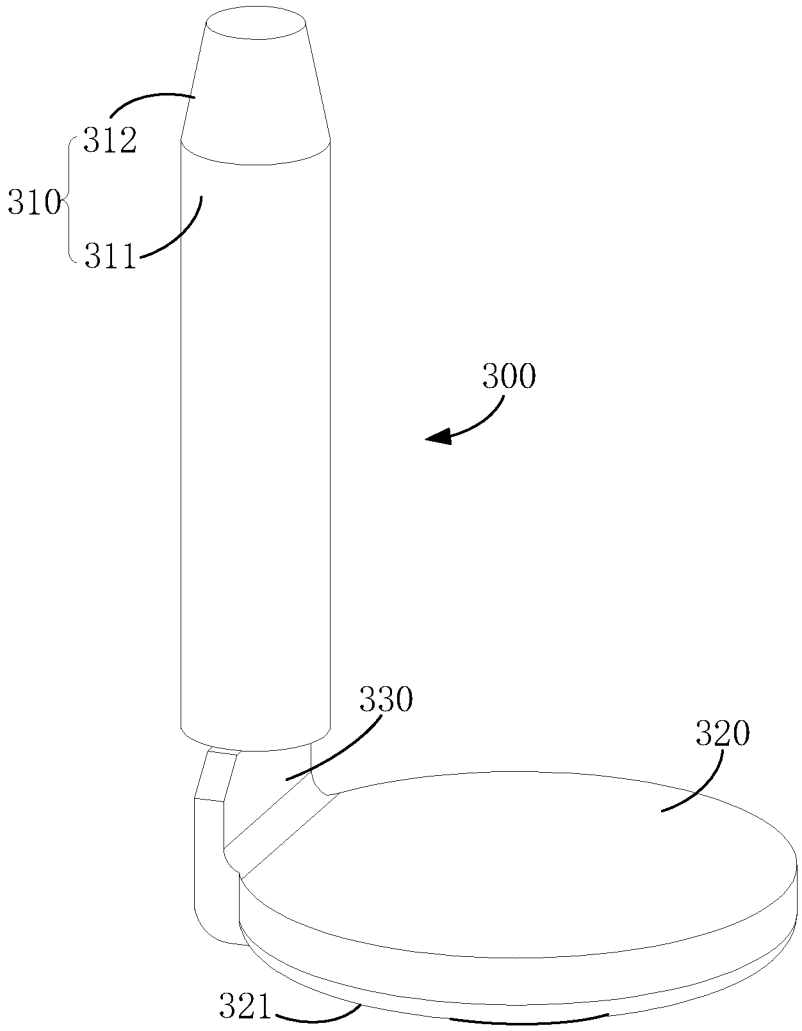
FIG. 11 is a perspective view of an electrode body of the atomizer shown in FIG. 8.

Referring to FIGS. 6 and 7, the atomizer 10 according to a second embodiment is similar to that of the first embodiment, while the main difference lies in that the electrode body 300 further includes a bottom disk 320.

The bottom disk 320 is provided at the lower end of the cylinder portion 311, and a dimension of the cross-section of the bottom disk 320 is greater than the dimension of the cross-section of the cylinder portion 311, such that the bottom disk 320 cannot be completely inserted into the mounting hole 110. The mounting surface 130 is provided with a counterbore 140, and the base assembly 100 further has a bottom wall surface 141 that defines part of a boundary of the counterbore 140. The bottom wall surface 141 and the mounting surface 130 are spaced apart in the axial direction of the conductive post 310, that is, both the bottom wall surface 141 and the mounting surface 130 are spaced apart in an up-and-down direction. The bottom wall surface 141 is disposed above the mounting surface 130, and the mounting surface 130 is further away from the atomizing core 200 relative to the bottom wall surface 141. The lower end of the mounting hole 110 extends through the bottom wall surface 141. The bottom disk 320 has an abutting surface 321 which, when the bottom disk 320 is received in the counterbore 140, can abut against the electrode of the power supply 20 to achieve electrical connection between the entire electrode body 300 and the power supply 20. The abutting surface 321 may be coplanar with the mounting surface 130. In another embodiment, the abutting surface 321 may be disposed in the counterbore 140 at a certain distance from the mounting surface 130, such that the abutting surface 321 is closer to the atomizing core 200 relative to the mounting surface 130.

In the mounting process, the diameter of the cylinder portion 311 is greater than the diameter of the mounting hole 110, such that the cylinder portion 311 and the mounting hole 110 form an interference fit relationship, and the interference degree between the cylinder portion 311 and the mounting hole 110 can be reasonably configured according to the actual situation. The bottom disk 320 is received in the counterbore 140, the abutting surface 321 of the bottom disk 320 abuts against the electrode of the power supply 220, and the upper end of the circular truncated cone portion 312 abuts against the electrode of the heating body 220 on the atomizing core 200, such that electrical connection between the power supply 220 and the heating body 220 can be realized, that is, the power supply 220 can provide electrical energy to the heating body 220 via the electrode body 300. Since the cross-section of the bottom disk 320 is greater than the dimension of the cross-section of the cylinder portion 311, the area of the abutting surface 321 of the bottom disk 320 is relatively large, that is, the area of the abutting surface 321 is greater than the area of the cross-section of the cylinder portion 311. Therefore, even if there is a large mounting error in the mounting process of the atomizer 10 and the power supply 20, it can be ensured that the electrode of the power supply 20 abuts against the abutting surface 321 with a larger area, such that the electrode of the power supply 20 forms good contact with the entire electrode body 300, and the stability and reliability of the electrical connection between the electrode body 300 and the electrode of the power supply are improved.

In one embodiment, the bottom disk 320 may be made of magnetic or ferromagnetic material, such that the bottom disk 320 has certain magnetic or ferromagnetic properties. When the bottom disk 320 is in contact with the electrode of the power supply 20, both the bottom disk 320 and the electrode of the power supply 20 are in contact with each other via a magnetic attraction force, so as to avoid the poor contact between the bottom disk 320 and the electrode of the power supply 20, thereby improving the stable reliability of the electrical connection between the bottom disk 320 and the electrode of the power supply 20. It should be noted that, similar to the first embodiment, the bottom disk 320 may be made of one of magnetic material or ferromagnetic material, and one of a ferromagnetic member or a magnetic member may be provided corresponding to the power supply 20 configured to generate a magnetic attraction force with the bottom disk 320.

Referring to FIGS. 8, 9, 10, and 11, the atomizer 10 according to a third embodiment is similar to that of the second embodiment, while the main difference lies in that the electrode body 300 further includes a positioning portion 330.

The positioning portion 330 is substantially shaped as flat plate. An upper end of the positioning portion 330 is connected to the lower end of the cylinder portion 311, and a lower end of the positioning portion 330 is connected to the bottom disk 320. When regarding each of the positioning portion 330 and the bottom disk 320 as a plane, the plane in which the positioning portion 330 is located may be perpendicular to the plane in which the bottom disk 320 is located. A dimension of the cross-section of the bottom disk 320 is greater than the dimension of the cross-section of the cylinder portion 311, such that the bottom disk 320 cannot be completely inserted into the mounting hole 110. The mounting surface 130 is provided with a counterbore 140. The base assembly 100 further has a bottom wall surface 141 and a sidewall surface 142, both of which cooperatively define a boundary of the counterbore 140. The sidewall surface 142 is substantially annular, a lower end of the sidewall surface 142 is connected to the mounting surface 130, and an upper end of the side wall surface 142 is connected to the bottom wall surface 141. The bottom wall surface 141 and the mounting surface 130 are spaced apart in the axial direction of the conductive post 310, that is, both the bottom wall surface 141 and the mounting surface 130 are spaced apart in an up-and-down direction. The bottom wall surface 141 is located above the mounting surface 130, and the mounting surface 130 is further away from the atomizing core 200 relative to the bottom wall surface 141. The lower end of the mounting hole 110 extends through the bottom wall surface 141. The sidewall surface 142 is provided with a groove 150 in fluidly communication with the mounting hole 110. When the bottom disk 320 is received in the counterbore 140, the conductive post 310 is inserted into the mounting hole 110, and the positioning portion 330 is limited in the groove 150. By the engagement of the positioning portion 330 and the groove 150, the groove 150 has a position limiting effect on the positioning portion 330, such that the entire electrode body 300 can be engaged with the counterbore 140 and the mounting hole 110 at an appropriate position, and the mounting accuracy and the mounting efficiency of the electric body are improved.

The bottom disk 320, the positioning portion 330, and the conductive post 310 may be integrally formed, such that the entire electrode body 300 has an integral structure. For example, the electrode body 300 may be formed by a forging process or a casting process to form the integral structure, such that the processing efficiency of the electrode body 300 can be improved and the manufacturing cost can be reduced.

The technical features of the embodiments described above may be arbitrarily combined. For the sake of brevity of description, not all possible combinations of the technical features in the aforementioned embodiments are described. However, as long as there is no contradiction between the combinations of these technical features, all should be considered as the scope of this specification.

The aforementioned examples only express several implementation of the present disclosure, and the descriptions thereof are more specific and detailed, but they cannot be understood as a limitation on the scope of the present disclosure. It should be noted that, for those who skilled in the art, a plurality of modifications and improvements can be made without departing from the concept of the present disclosure, which all belong to the protection scope of the present disclosure. Therefore, the protection scope of the present disclosure shall be subject to the appended claims.

What is claimed is:

1. An atomizer, comprising:

a base assembly provided with a mounting hole in fluid communication with an outside atmosphere;

an atomizing core at least partially located in the base assembly and configured to atomize liquid; and an electrode body comprising a conductive post electrically connected to the atomizing core, the conductive post comprising a cylinder portion with a circular cross-section, and the cylinder portion being in interference fit with the mounting hole to seal the mounting hole, the conductive post further comprising a circular truncated cone portion abutting against the atomizing core, the circular truncated cone portion having a circular cross-section and is arranged coaxially with the cylinder portion, a dimension of the cross-section of the circular truncated cone portion gradually decreasing along an axial direction towards the atomizing core wherein the electrode body further comprises a bottom disk connected to the cylinder portion, the base assembly has a mounting surface facing a power supply, the mounting surface is provided with a counterbore, the base assembly further has a bottom wall surface defining part of a boundary of the counterbore, the bottom wall surface and the mounting surface are spaced apart along an axial direction of the cylinder portion, the mounting hole extends through the bottom wall surface, a dimension of a cross-section of the bottom disk is greater than a dimension of the cross-section of the cylinder portion, and the bottom disk is received in the counterbore and configured to abut against an electrode of the power supply;

wherein the base assembly further has a sidewall surface defining a part of a boundary of the counterbore, one end of the sidewall surface is connected to the bottom wall surface, the other end of the sidewall surface is connected to the mounting surface, the sidewall surface is provided with a groove in fluid communication with the mounting hole, the electrode body further comprises a positioning portion connected between the bottom disk and the cylinder portion, and the positioning portion is shaped as a flat plate and limited in the groove, a plane in which the positioning portion is located is perpendicular to a plane in which the bottom disk is located.

2. The atomizer according to claim 1, wherein the electrode body is magnetic or ferromagnetic.

3. The atomizer according to claim 1, wherein the base assembly is further provided with an atomizing cavity in fluid communication with the mounting hole, and the conductive post is at least partially located in the atomizing cavity and abuts against the atomizing core.

4. The atomizer according to claim 1, wherein the mounting hole is a round hole, and a diameter of the mounting hole is kept constant along an axial direction of the mounting hole.

5. The atomizer according to claim 1, wherein the bottom disk has an abutting surface abutting against the electrode of the power supply, and the abutting surface is located in the counterbore and is staggered from the mounting surface.

6. The atomizer according to claim 1, wherein the bottom disk has an abutting surface abutting against the electrode of the power supply, and the abutting surface is located in the counterbore and is coplanar with the mounting surface.

7. The atomizer according to claim 1, wherein the electrode body is integrally formed by a forging process or a casting process.

8. The atomizer according to claim 1, wherein the atomizing core comprises a heating body made of metal material and a ceramic substrate made of porous ceramic material.

9. The atomizer according to claim 8, wherein the ceramic substrate has an atomizing surface located in the atomizing cavity, and the heating body is attached to the atomizing surface.

10. The atomizer according to claim 8, wherein a lower end of the cylinder portion abuts against an electrode of a power supply, and an upper end of the circular truncated cone portion abut against an electrode of the heating body.

11. An electronic atomizing device, comprising a power supply and the atomizer of claim 1 detachably connected to the power supply.

* * * * *